US008215383B2

(12) United States Patent
Willis

(10) Patent No.: US 8,215,383 B2
(45) Date of Patent: Jul. 10, 2012

(54) STRESS AND TORQUE REDUCING TOOL

(75) Inventor: Charles David Willis, Granbury, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 0 days.

(21) Appl. No.: 13/110,601

(22) Filed: May 18, 2011

(65) Prior Publication Data

US 2011/0284205 A1 Nov. 24, 2011

Related U.S. Application Data

(63) Continuation of application No. 12/147,006, filed on Jun. 26, 2008, now Pat. No. 7,950,449.

(60) Provisional application No. 60/947,734, filed on Jul. 3, 2007.

(51) Int. Cl.
*E21B 17/07* (2006.01)
*F04B 39/10* (2006.01)

(52) U.S. Cl. ..... 166/109; 166/105.2; 166/242.7; 417/545

(58) Field of Classification Search ..... 166/105.2, 166/109, 242.7; 417/545
See application file for complete search history.

(56) References Cited

U.S. PATENT DOCUMENTS

| | | | |
|---|---|---|---|
| 2,103,236 | A | 12/1937 | Coshow |
| 3,013,793 | A | 12/1961 | Howell et al. |
| 3,551,012 | A | 12/1970 | Downen et al. |
| 4,778,359 | A | 10/1988 | Pridy et al. |
| 4,963,078 | A | 10/1990 | Agee |
| 4,997,037 | A | 3/1991 | Coston |
| 5,236,038 | A | 8/1993 | Clemishire |
| 5,356,114 | A | 10/1994 | Havard |
| 5,509,475 | A | 4/1996 | Lewis |
| 6,068,052 | A | 5/2000 | Dobbs |
| 6,746,221 | B1 | 6/2004 | Havard |
| 6,905,114 | B2 | 6/2005 | Ford |
| 2004/0140087 | A1 | 7/2004 | Ferguson et al. |
| 2005/0023739 | A1 | 2/2005 | Ford |
| 2008/0041579 | A1 | 2/2008 | Dobbs |
| 2008/0252088 | A1 | 10/2008 | Kelso |
| 2009/0008080 | A1 | 1/2009 | Willis |
| 2009/0146442 | A1 | 6/2009 | Kelso |

FOREIGN PATENT DOCUMENTS

| | | | |
|---|---|---|---|
| SU | 1599518 | A | 10/1990 |

OTHER PUBLICATIONS

Photograph of pumps showing pump clutches, Harbison-Fischer, HF 4-02.

7 sheets of Design #1, #2, #3 and #4 of tools built and tested by John Agee.

*Primary Examiner* — Jennifer H Gay
(74) *Attorney, Agent, or Firm* — Geoffrey A. Mantooth

(57) ABSTRACT

A stress and torque reducing tool has a plunger that reciprocates inside of a body. The tool is connected between the pump and the sucker rod string and reduces stress transmitted therebetween. The body and plunger have longitudinally extending surfaces located at the plunger upper end portion, which surfaces cooperate and limit rotation of the body with respect to the plunger. An upper fluid port is located in an upper end of the body, while one or more lower fluid ports are located in a lower end of the body.

6 Claims, 3 Drawing Sheets

STRESS AND TORQUE REDUCING TOOL

This application is a continuation of application Ser. No. 12/147,006, filed Jun. 26, 2008, now U.S. Pat. No. 7,950,449, which application claims the benefit of U.S. provisional patent application Ser. No. 60/947,734, filed Jul. 3, 2007.

FIELD OF THE INVENTION

The present invention relates to apparatuses for reducing stress and torque on downhole and above ground oil well production equipment.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells and in particular those in fields that are established and aging, natural pressure has declined to the point where the oil must be artificially lifted to the surface. A subsurface sucker rod pump is located down in the well below the level of the oil. A string of sucker rods extends from the pump up to the surface to a pump jack device, or beam pump unit, or other vertical reciprocation machine. A prime mover, such as a gasoline or diesel engine, or an electric motor, or a gas engine, on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a compression chamber between the valves with fluid and then lifts the fluid up the tubing toward the surface.

In the operation of reciprocating the pump, the sudden reversal of movement at the end of the upstroke and the downstroke of the sucker rods imposes reversal strains on the sucker rods as the stretch of the sucker rods is either suddenly released or suddenly imposed upon the rods.

In addition, the subsurface pump used in connection with the sucker rods can undergo what is known as gas lock. This is a condition which occurs when gas enters the compression chamber. The plunger cannot compress the gas to a pressure sufficient to force the traveling valve open. As the plunger is reciprocated, the gas inside the compression chamber is compressed and expanded.

In the prior art, one way to compensate for gas lock is to space the plunger so that it bumps the bottom on every downstroke in order to eliminate gas lock. This action of bumping the bottom causes destructive effects. It increases the stress range on the sucker rods. It causes the rods to go into the compression state each and every time the pump bumps the bottom. It also causes the rods to buckle and slap inside of the tubing, which causes increased wear to the rods, rod couplings and tubing. When the pump bumps bottom it causes the entire weight of the rods to be transferred to the tubing string in a shock load, which can cause premature failure of tubing couplings and threads. Such shock loads are also transferred to the pumping unit when the pump bumps bottom resulting in premature failure of the structural bearings and torque reversals in the gears in the gear box causing excessive wear on the gear teeth and gear box bearing.

Another condition is known as "fluid pound" and occurs in situations where the compression chamber is partially filled with liquid and gas. As the plunger moves on the downstroke through the gas it encounters the interface with the fluid and severely jars the sucker rods in the pump. A similar condition is called a "gas pound" and occurs when the plunger on the downstroke compresses gas to a pressure greater than the rod weight but not sufficient pressure to open the traveling valve. Unintentional gas or fluid pounding in operation of conventional pumps is a common problem in low fluid level wells and marginal producing wells.

U.S. Pat. No. 4,963,078 introduced a stress and torque reducing tool. The stress and torque reducing tool is located between the downhole pump and the sucker rod string and employs a plunger to effectively isolate the sucker rod string from the shock forces of the downhole pump. The plunger is housed in a body, which body has ports located above and below the plunger. The ports allow the entry and exit of well fluid so as to dampen the reciprocal movement of the plunger inside of the body.

The stress and torque reducing tool of the '078 patent has proven effective in reducing stress and torque in the sucker rod string. However, due to the severe stresses and torque suffered by the tool, the tool occasionally fails by breaking. Such failure occurs by the body breaking at one of the sets of ports (typically the ports located above the plunger). Therefore, it is desirable to have a stress and torque reducing tool that is less likely to fail.

SUMMARY OF THE INVENTION

The present invention provides an apparatus for use in coupling a sucker rod string to a downhole pump. The apparatus comprises a body and a plunger. The body has first and second ends, a side wall and a cavity between the first and second ends. The first end is structured and arranged to couple to one of either the sucker rod string or the pump. The plunger is located in the body cavity and is structured and arranged to reciprocate therein. The plunger has an upper end portion. The plunger has a shaft that extends out through the body second end. A coupler is attached to the plunger shaft and is structured and arranged to couple to the other of the sucker rod string or the pump. The body first end has a first surface located in the cavity and extending longitudinally therein. The plunger upper end portion has a second surface extending longitudinally within the cavity. The first and second surfaces cooperate with one another such that the plunger can reciprocate in the body cavity, with one of the first and second surfaces limiting the rotation of the other of the first and second surfaces about a longitudinal axis of the apparatus for substantially all of the plunger reciprocation stroke.

In accordance with one aspect of the present invention, the body first end comprises a first cylinder portion that incorporates the first surface, with the plunger upper end portion comprising a second cylinder portion that incorporates the second surface.

In accordance with still another aspect of the present invention, the coupler is a second coupler. The body first end comprises a first coupler coupled to the body. The first coupler incorporates the first surface.

In accordance with still another aspect of the present invention, an upper fluid port extends from the cavity into the body first end and to the exterior of the body.

In accordance with still another aspect of the present invention, the upper fluid port comprises channels in the first and second surfaces, which channels are aligned with each other.

In accordance with still another aspect of the present invention, a lower fluid port extends from the cavity through the body second end to the exterior of the body.

In accordance with still another aspect of the present invention, the plunger shaft extends out through an aperture of the body second end. The lower fluid port comprises a channel in the body aperture.

In accordance with still another aspect of the present invention, an upper fluid port extends from the cavity into the body first end and to the exterior of the body. A lower fluid port extends from the cavity through the body second end to the exterior of the body.

In accordance with still another aspect of the present invention, the upper fluid port comprises channels in the first and second surfaces, which channels are aligned with each. The plunger shaft extends out through an aperture in the body second end. The lower fluid port comprises a channel in the aperture.

In accordance with still another aspect of the present invention, the plunger upper end portion comprises a stop surface that contacts a first stop in the body cavity when the plunger is in a top position in the body cavity.

In accordance with still another aspect of the present invention, the body first end comprises a first cylinder portion that incorporates the first surface. The plunger upper end portion comprises a second cylinder portion that incorporates the second surface. An upper fluid port extends from the cavity into the body first end and to the exterior of the body. The upper fluid port comprises channels in the first and second surfaces, which channels are aligned with each other. A lower fluid port extends from the cavity through the body second end to the exterior of the body. The plunger shaft extends out through an aperture in the body second end. The lower fluid port comprises a channel in the aperture.

The present invention also provides an apparatus for coupling the sucker rod string to a downhole pump, which comprises a body and a plunger. The body has first and second ends, a side wall and a cavity between the first and second ends. The first end is structured and arranged to couple to one of the sucker rod string or the pump. The plunger is located in the body cavity. The plunger is structured and arranged to reciprocate in the body cavity. The plunger has an upper end portion and a shaft that extends out through the body second end. A coupler is attached to the plunger shaft and is structured and arranged to couple to the other of the sucker rod string or the pump. An upper fluid port extends from the cavity into the body first end and to the exterior of the body. A lower fluid port extends from the cavity through the body second end to the exterior of the body.

In accordance with still another aspect of the present invention, the plunger shaft extends out through an aperture in the body second end. The lower fluid port comprises a channel in the aperture.

DESCRIPTION OF THE PREFERRED EMBODIMENT

Figure 1:
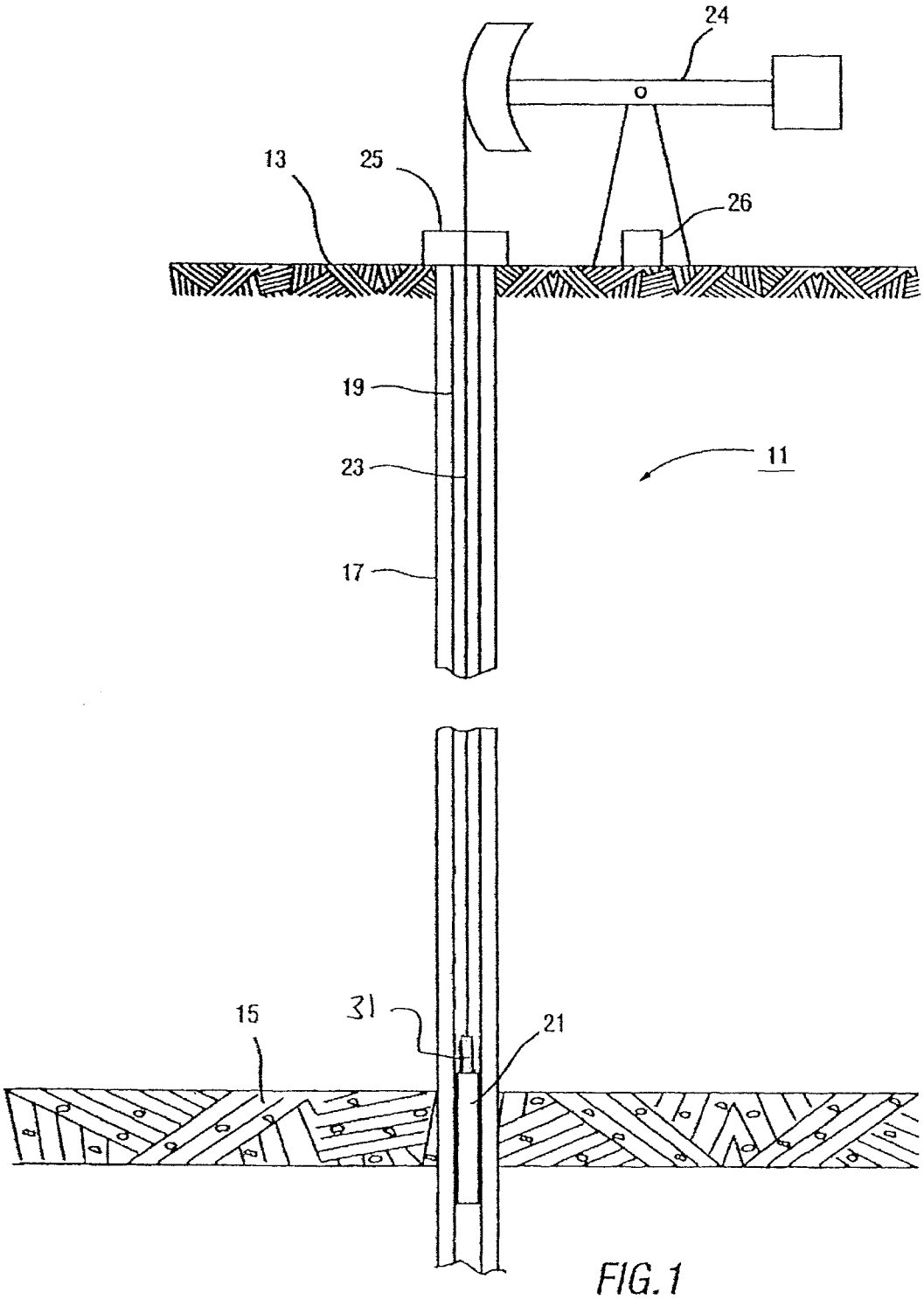
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation 15. A packer or other device or method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit 24 which reciprocates up and down due to a prime mover 26, such as an electric motor or gasoline or diesel engine, or gas engine.

The pump 21, which is of the reciprocating type, has a barrel and a plunger. In a fixed barrel pump, the plunger reciprocates and is coupled to the sucker rod string. In a fixed plunger pump, the barrel reciprocates and is coupled to the sucker rod string.

The reciprocating component of the pump, whether it be the plunger or the barrel, is coupled to the sucker rod string by a stress and torque reducing tool 31 of the present invention (STR Tool). The STR Tool 31 provides a plunger 33 within a body 35 (see FIG. 2). The STR Tool 31 acts as a shock absorber to limit the transmission of shock forces between the pump 21 and the sucker rod string 23, and thus to the surface equipment. The plunger 33 is prevented from rotating so as to limit torque. U.S. Pat. No. 4,963,078 describes the prior art stress and torque reducing tool. The entire disclosure of U.S. Pat. No. 4,963,078 is incorporated herein by reference.

In the description, terms such as "upper", "lower", "top", "bottom" and so on may be used. These terms are in reference to the orientation of the STR tool 31 shown in the drawings. The STR Tool can be used in orientations other than what is shown.

Figure 2:
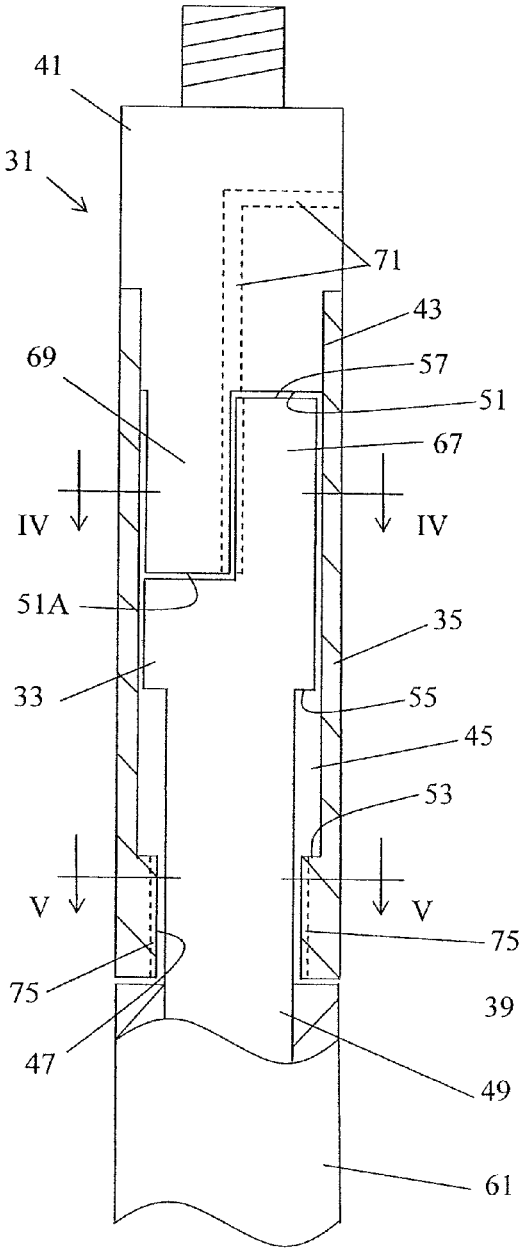
FIG. 2 is a longitudinal partial cross-sectional view of the stress and torque reducing tool (STR Tool) of the present invention, in accordance with a preferred embodiment, shown with the plunger in the top position.
Figure 3:
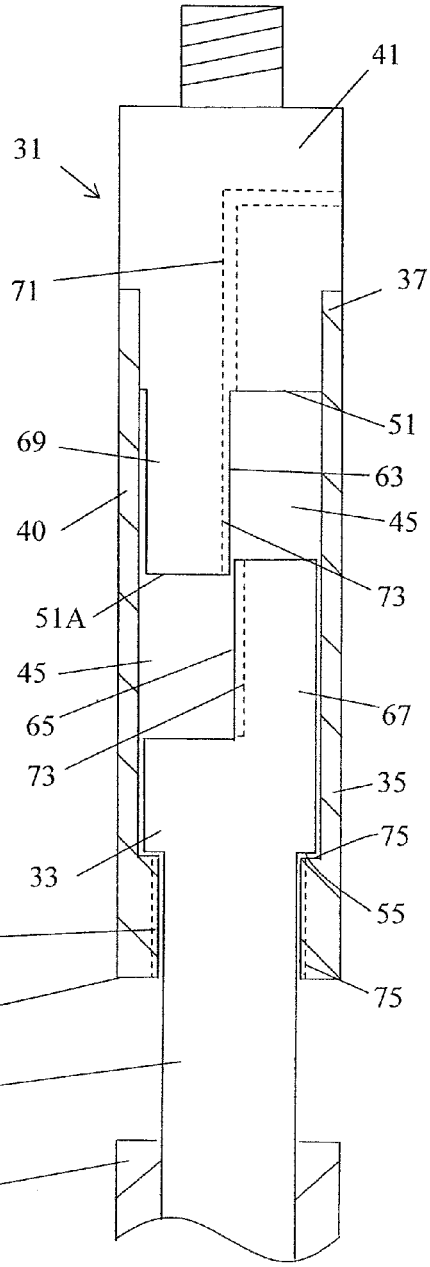
FIG. 3 is a longitudinal partial cross-sectional view of the STR Tool of FIG. 2, shown with the plunger at the bottom position.

Referring to FIGS. 2 and 3, the body 35 is generally tubular and has upper and lower ends 37, 39. A side wall 40 extends between the ends 37, 39. The upper end 37 is closed with an upper coupler 41. The upper coupler 41 connects to the lower end of the sucker rod string 23. The upper coupler can be a separate piece that fits into the body by way of a threaded coupling 43. Alternatively, the upper coupler 41 can be integral to the body 35.

The body 35 has an interior cavity 45 that extends longitudinally. The cavity 45 receives the plunger 33. The upper coupler 41 closes the upper end of the cavity 45. At the lower end of the cavity is an aperture 47 for receiving the shank 49 of the plunger 33. The wall thickness of the body 35 is greater at the aperture 47 than at the side wall 40.

The cavity 45 has an upper stop surface 51, which is the lower end of the upper coupler 41. The cavity has a lower stop surface 53 in the form of a shoulder above the aperture 47. The upper and lower stop surfaces 51, 53 limit the movement of the plunger 53 within the body 35.

The plunger 33 reciprocates inside of the cavity 45. The plunger has a shoulder 55 that contacts the lower stop surface 53, and an upper end 57 that contacts the upper stop surface 51. The plunger shank 49 extends out of the body through the aperture 47. A lower coupler 61 is attached to the lower end of the shank 49. The lower coupler 61 connects to the reciprocating component of the pump 21.

Figure 4:
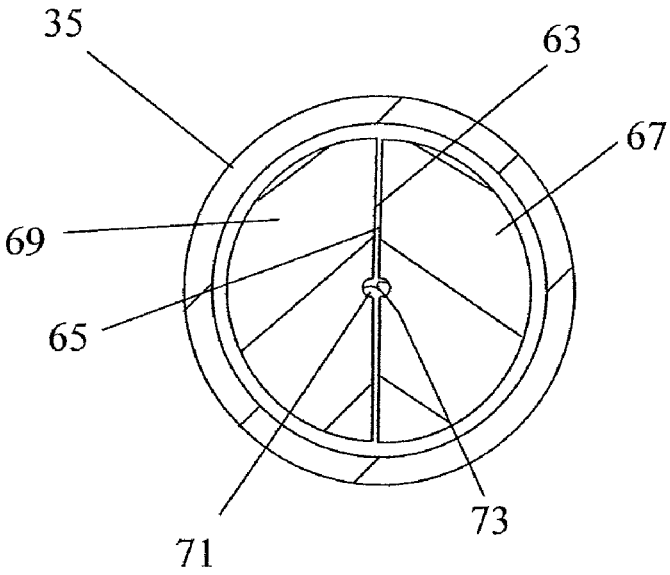
FIG. 4 is a cross-sectional view of the STR Tool taken along lines IV-IV of FIG. 2.

The cavity 45, plunger 33 and shank 49 are all cylindrical. A cylindrical shank 49 is easier, and less expensive, to manufacture than is the prior art square shank. In order to prevent rotation of the plunger 33 within the body 35, the plunger and body are provided with longitudinally extending surfaces 63, 65 that overlap. In the preferred embodiment, the surfaces 63, 65 are provided on dogs, or projections 67, 69. The body 35 has a semi-cylindrical projection 69 that extends from the upper coupler 41 into the cavity 45. The projection 69 is integral with the upper coupler 41. The plunger 33 has a semi-cylindrical projection 67 that extends up toward the upper coupler 41. As shown in FIGS. 2 and 4, the two projections 67, 69 are sized so as to make up two portions of a cylinder when the plunger is in its top position inside of the cavity 45. Each projection 67, 69 has a flat, which flat makes up the longitudinally extending surface 63, 65. As the plunger 33 reciprocates inside of the cavity 45, the plunger projection 67 moves longitudinally with respect to the body projection 69. To the extent that the surfaces 63, 65 contact each other, the surfaces slide against each other. The longitudinally extending surfaces 63, 65 limit one projection from rotating about the longitudinal axis of the tool with respect to the other projection. Thus, the plunger 33 cannot rotate relative to the body 35 and vice versa. The surfaces 63, 65 longitudinally overlap to some degree, no matter what the plunger position might be. When the plunger is in its top position, as shown in FIG. 2, the surfaces 63, 65 completely overlap. When the plunger is in its bottom position, as shown in FIG. 3, the surfaces partially overlap. Because the surfaces 63, 65 overlap for the entire stroke of the plunger (whether the plunger is in its top position as shown in FIG. 2 or in its bottom position as shown in FIG. 3), rotation is limited no matter what the position of the plunger is. Some minor rotation may be permitted due to manufacturing tolerances. However, for practical purposes, this rotation is negligible.

The STR Tool 31 has ports above and below the plunger 33 to permit the ingress and egress of liquid between the body cavity 45 and the exterior. Instead of having the ports through the body side wall 40, the ports extend through the body ends 37, 39, where the wall thickness is greater than the side wall thickness. A upper port 71 is provided by drilling a longitudinal bore into the upper coupler 41 from the stop surface 51 toward the upper end thereof. Another bore is drilled from the outside surface radially to intersect the longitudinal bore, wherein the port 71 is formed from the two bores. The port 71 is effectively extended into the projections 67, 69 and the cavity 45 by way of grooves 73 on the surfaces 63, 65.

Lower ports 75 are formed in the lower end of the body by longitudinal grooves that line the aperture 47.

Figure 5:
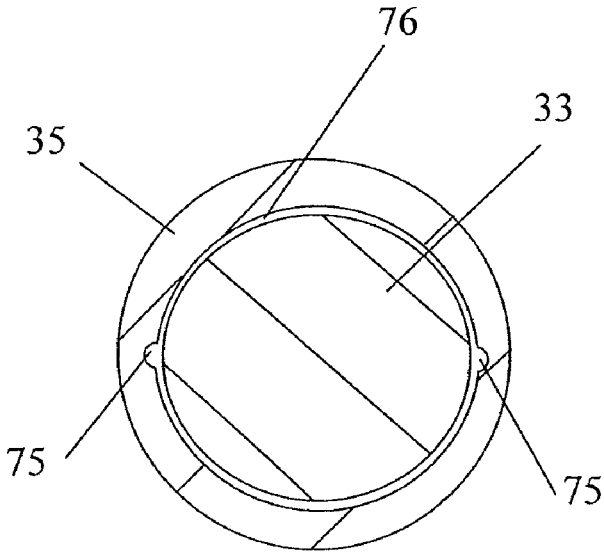
FIG. 5 is a cross-sectional view of the STR Tool taken along lines V-V of FIG. 2.

As can be seen by FIG. 2, the wall thicknesses surrounding the upper port 71 are considerably greater than the wall thickness of the body side wall 40. Likewise, as can be seen by FIGS. 2 and 5, the wall thicknesses of the body at the lower ports 75 is thicker than at the body side wall 40. Thus, the location and arrangement of the ports in the body, where the wall is thick, produces a strong tool but is less likely to fail than if the ports were located in the body side wall.

In the preferred embodiment, there is one upper port 71 and two lower ports 75. However, the number and size can be varied. Also, the placement can be varied. In the preferred embodiment, the upper port 71 is located along the longitudinal axis of the tool, except for the radial component. Also in the preferred embodiment, the two lower ports are diametrically opposite of each other. The lower port 75 can be annular shaped, between the plunger shank 49 and the aperture 57. If the lower port is the annulus 76 (see FIG. 5) between the plunger shank and the aperture, then the clearance or gap between the plunger shank and the aperture is sufficiently large so as to provide for satisfactory fluid flow.

To assemble the STR Tool 31, the plunger shank 49 is inserted into the upper end 37 of the body interior cavity 45. The shank 49 is inserted through the aperture 47, wherein the plunger 33 is located in the interior cavity 45, with the projection 67 directed toward the upper end 37. The upper coupler 45 is then installed onto the body upper end 37, such that the projection 69 is directed toward the plunger 33. The upper coupler 41 is coupled to the body, typically by threads. The lower coupler 61 is coupled to the plunger shank 49, typically by threads. The STR Tool 31 is assembled and ready for use. The STR Tool 31 is installed in line with the sucker rod string and the pump. The STR Tool 31 is connected or coupled to the pump, either directly or through other equipment.

In operation, as the plunger 33 moves toward its top position (this corresponds to the downstroke of the sucker rod string), fluid in the cavity 45 above the plunger exits through the upper port 71 to the exterior of the STR tool. Fluid in the portion of the cavity between the body projection 69 and the plunger 33 exits through the grooves 73 into the portion of the cavity between the projection 67 and the upper coupler 41. Fluid in the portion of the cavity between the projection 67 and the upper coupler 41 exits through the upper port 71. Fluid is drawn into the cavity below the plunger through the lower ports 75. At its top position, the plunger contacts the stop surface 51. In the preferred embodiment, the stop surface is shown as being on the bottom of the upper coupler 41. (In FIG. 2, a gap is shown between surfaces 51 and 57 so as to illustrate these surfaces.) Alternatively, the stop surface could be at the bottom of the projection 69 (as shown by 51A), or both surfaces 51, 51A could be used as stop surfaces. As the plunger moves toward its bottom position (this corresponds to the upstroke of the sucker rod string), fluid is drawn into the cavity 45 above the plunger through the upper port 71 (fluid is distributed to the portion of the cavity between the projection 69 and the plunger by way of the grooves 73) and is expelled from the cavity below the plunger through the lower ports 75. At its bottom position, the plunger shoulder 55 contacts the lower stop surface 53 as shown in FIG. 3. Thus, stress is reduced on the sucker rod string and surface equipment due to the dampening action of the STR Tool. In addition, torque on the surface pumping unit is reduced, due to the dampening action of the STR Tool.

The plunger and body cannot rotate with respect to each other due to the fact that the two projections 67, 69 are engaged with one another. The two surfaces 63, 65 cooperate and each prevents rotation of the other. This allows the STR Tool and the pump to operate without creating torque reversal in the gear box of the surface pumping unit. It also allows the reciprocating component of the pump to be pulled from the well with the STR Tool in either the top or bottom positions or some position intermediate thereto.

Although the non-rotation surfaces 63, 65 have been described as portions of a semi-cylinder and as flat, the surfaces can have other configurations. The longitudinally extending surfaces 63, 65 need not be flat but can have curves and/or corners when viewed in transverse cross-section.

The STR Tool 31 is very strong and easy to manufacture. As a strong tool, the tool is less likely to fail. This is due to the location of the ports in the tool ends where the wall thickness is greater. The tool is easy to manufacture with its cylindrical plunger shank 49. The two surfaces 63, 65 are also easy to manufacture.

Although the STR Tool 31 has been described as having the plunger 33 contact the upper coupler 41 when the plunger is at its top position (by way of stop surfaces 51, 51A), this need not be the case. Alternatively, the lower coupler 61 could contact the lower end 39 of the body 35 when the plunger is at its top position.

Although the STR Tool 31 has been described as having its upper coupler 41 coupled to the sucker rod string and the plunger coupled to the pump, the STR tool could be reversed, or turned upside down, so that the upper coupler 41 is coupled to the pump and the plunger 33 is coupled to the sucker rod string.

The foregoing disclosure and showings made in the drawings are merely illustrative of the principles of this invention and are not to be interpreted in a limiting sense.

The invention claimed is:

1. An apparatus for coupling a sucker rod string to a downhole pump, comprising:

a) a body having first and second ends, a side wall, the first and second ends and the side wall defining a cavity, the body first end comprising a first coupler;

b) a plunger located in the body cavity, the plunger structured and arranged to reciprocate in the body cavity, the plunger having an upper end portion, the plunger having a shaft that extends out through the body second end, the plunger lacking a valved fluid passage that allows fluid to flow through the plunger;

c) a second coupler attached to the plunger shaft, wherein when the apparatus is put into use the first coupler will couple to one of either the sucker rod string or the pump and the second coupler will couple to the other of the sucker rod string or the pump;

d) a first fluid port extending from the cavity into the first coupler and to the exterior of the body;

e) a second fluid port extending from the cavity through the body second end to the exterior of the body.

2. The apparatus of claim 1 wherein the first and second fluid ports lack valves.

3. The apparatus of claim 1 wherein the first coupler is removably coupled to the body first end.

4. The apparatus of claim 3 wherein the first coupler is threaded to the body first end.

5. The apparatus of claim 3 wherein the second fluid port comprises an annulus around the plunger shaft.

6. The apparatus of claim 1 wherein the second fluid port comprises an annulus around the plunger shaft.

* * * * *